US006443592B1

(12) United States Patent
Unger et al.

(10) Patent No.: US 6,443,592 B1
(45) Date of Patent: Sep. 3, 2002

(54) LUMINAIRE HAVING ANNULAR INNER HOUSING WITH DETACHABLE ANNULAR LOUVER SUPPORT ELEMENT

(75) Inventors: Helmuth K. Unger, Menden; Karl-Heinz Brechelt, Lemgo, both of (DE)

(73) Assignee: WILA Leuchten AG, Sevelen SG (CH)

( * ) Notice: Subject to any disclaimer, the term of this patent is extended or adjusted under 35 U.S.C. 154(b) by 0 days.

(21) Appl. No.: 09/498,167

(22) Filed: Feb. 4, 2000

(30) Foreign Application Priority Data

Feb. 6, 1999 (DE) ..... 199 04 933

(51) Int. Cl.[7] ..... F21S 8/00

(52) U.S. Cl. ..... 362/147; 362/257; 362/216; 362/290; 362/292; 362/260

(58) Field of Search ..... 362/147, 257, 362/216, 223, 290, 291, 292, 342, 354, 260

(56) References Cited

U.S. PATENT DOCUMENTS 4,282,563 A 8/1981 Ohta et al. ..... 362/216
4,617,615 A * 10/1986 Eychaner ..... 362/216
5,251,118 A * 10/1993 Budnovitch et al. ..... 362/362

FOREIGN PATENT DOCUMENTS

| | | | |
|---|---|---|---|
| DE | 9200978.6 | 4/1992 | |
| DE | 4414742 A1 | 11/1995 | |
| EP | 0684425 A2 | 2/1995 | |
| EP | 0 684 425 A2 | 2/1995 | ..... 362/291 |
| GB | 702677 | 1/1954 | |
| JP | 0010074417 | 3/1998 | |

* cited by examiner

*Primary Examiner*—Sandra O'Shea
*Assistant Examiner*—Bertrand Zeade
(74) *Attorney, Agent, or Firm*—Flanagan & Flanagan; John R. Flanagan

(57) ABSTRACT

A luminaire has an inner annular housing separating an interior cavity of an outer annular housing of the luminaire into a central portion and an outer annular portion. The luminaire also has an annular support element detachably mounted to a bottom end of the inner annular housing and removably supporting an annular louver in the outer annular portion of the interior cavity outside of the inner annular housing and below an illumination lamp of the luminaire.

20 Claims, 4 Drawing Sheets

LUMINAIRE HAVING ANNULAR INNER HOUSING WITH DETACHABLE ANNULAR LOUVER SUPPORT ELEMENT

BACKGROUND OF THE INVENTION

1. Field of the Invention

The present invention generally relates to a luminaire having an annular illumination lamp with a subjacent annular louver which must be removed in order to replace the lamp and, more particularly, is concerned with such a luminaire having an inner annular housing separating an interior cavity of an outer annular housing of the luminaire into a central portion and an outer annular portion and an annular support element detachably mounted to the inner annular housing and removably supporting the annular louver in the outer annular portion outside of the inner annular housing and below the lamp.

2. Description of the Prior Art

In a luminaire known from German patent document no. DE 44 14 742 A1, there is disposed below an annular fluorescent lamp of the luminaire an annular reflector with lamella-form dimming elements commonly referred to as a louver. The fastening elements of such reflector and louver are accessible via an interior space delimited by the lamp. In addition, the interior space is utilized for accommodating a fluorescent lamp ballast.

This German patent document also proposes to use this interior space for accessories by disposing therein technical illumination installations or the other devices such as radiators, sprinklers, loudspeaker or ventilation devices. In a luminaire of the above type, such diverse accessory devices can only be mounted from a roof of the luminarie. However, the disposition of such accessory devices in the interior space and their mounting to the luminaire roof makes access to and removal of the reflector and louver difficult, for example, in the event of failure of the fluorescent lamp.

Consequently, a need exists for an innovation which will accommodate in a luminaire of the above type the desired luminaire accessories in a multifunctional manner in the interior space of the luminaire separately from the reflector and louver or their fastening elements.

SUMMARY OF THE INVENTION

The present invention provides a luminaire that overcomes the aforementioned problems and is designed to satisfy the aforementioned need. The luminaire of the present invention includes an outer annular housing defining an interior cavity and an inner annular housing separating the interior cavity of the outer annular housing into a central portion to accommodate illumination installation parts and accessories and an outer annular portion to accommodate an annular illumination lamp and an annular louver. The annular louver disposed below the illumination lamp must be removed in order to replace the lamp. The luminaire also includes an annular support element detachably mounted to the inner annular housing to removably support the annular louver. By rotation relative to the inner annular housing, the annular support element is easily detached therefrom to remove the annular louver without disturbing the parts and accessories in the central portion of the interior cavity. The inner annular housing can also be installed and removed by rotation relative to a roof of the luminaire. The luminaire of the present invention can thereby be equipped in a multifunctional manner.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
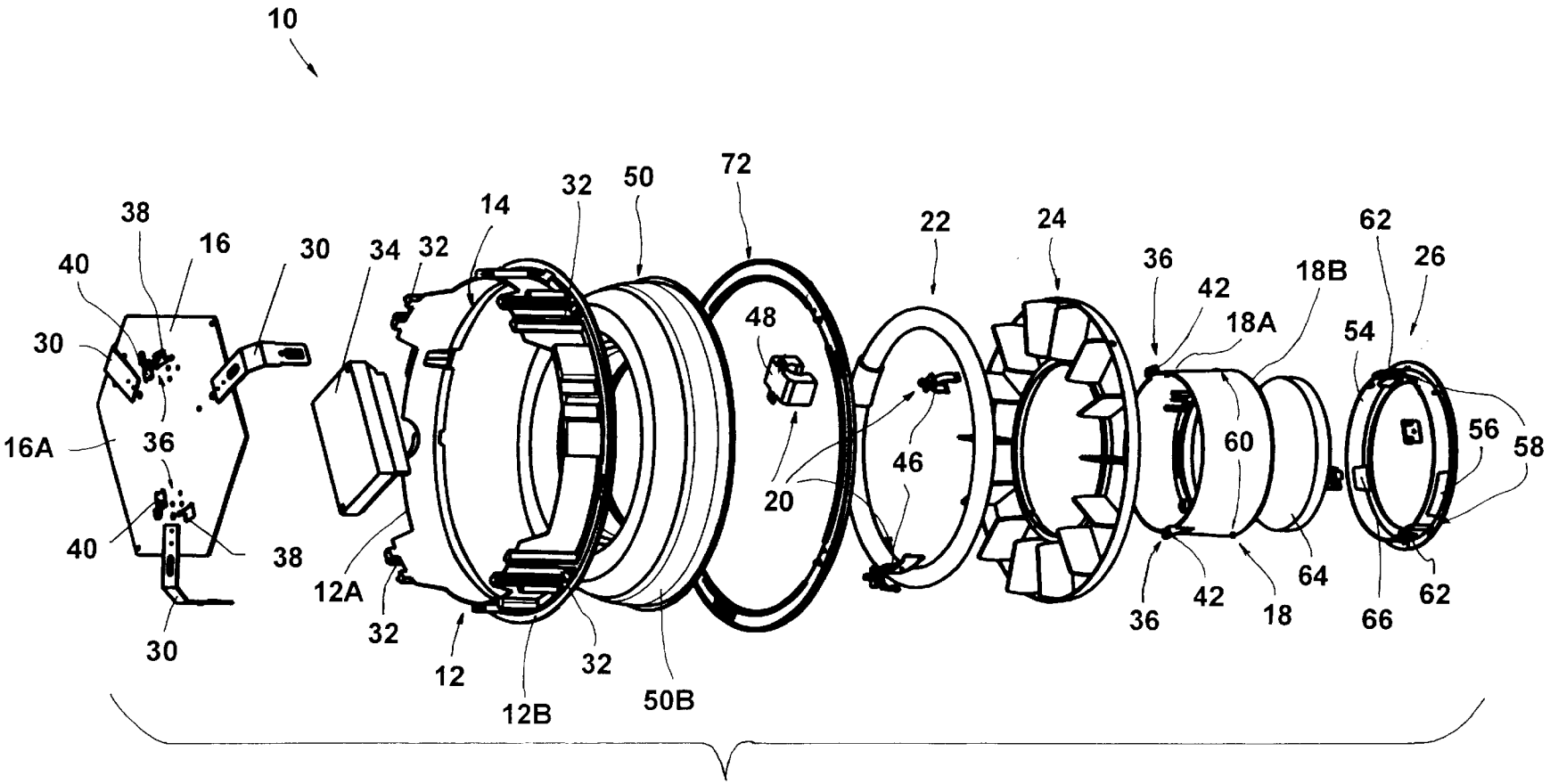
FIG. 1 is an exploded perspective view of a luminaire according to the present invention.
Figure 2:
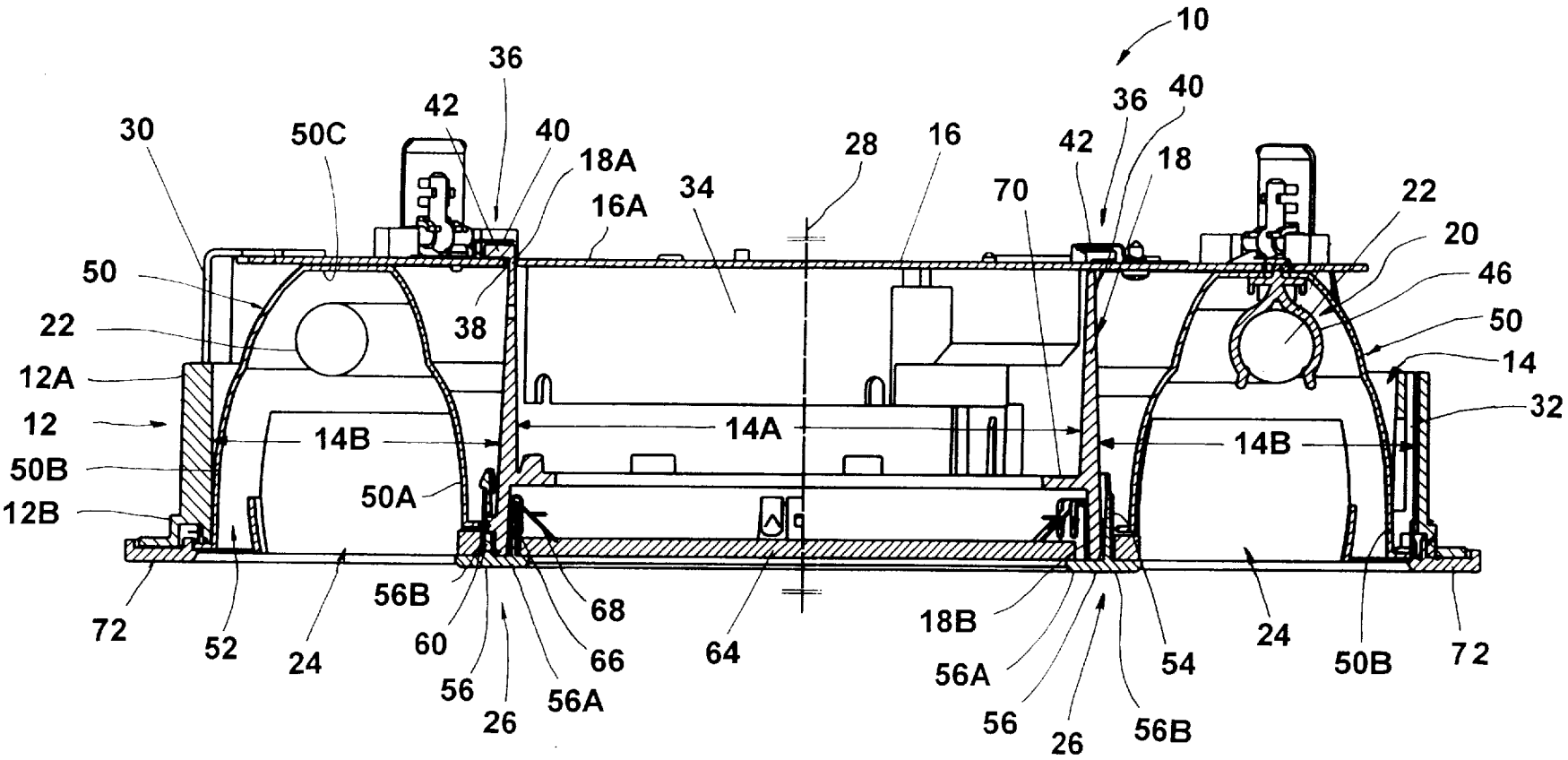
FIG. 2 is an enlarged assembled longitudinal sectional view of the luminaire of FIG. 1.

Referring to the drawings and particularly to FIGS. 1 and 2, there is illustrated an exemplary embodiment of a luminaire, generally designated 10, according to the present invention. The luminaire 10 additionally may be enclosed by a concealment housing (not shown) . The luminaire 10 basically includes an outer annular housing 12 defining an interior cavity 14, a roof 16, an inner annular housing 18, lamp holding means 20 for supporting an annular illumination lamp 22, an annular louver 24 and an annular support element 26. The roof 16 is disposed in an overlying relationship to the outer annular housing 12 and the interior cavity 14 thereof. The inner annular housing 18 is supported from the roof 16 within the outer annular housing 12 and spaced radially inwardly from and concentric with the outer annular housing 12 so as to separate the interior cavity 14 of the outer housing 12 into a central portion 14A disposed inside or interiorly of the inner annular housing 18 and an outer annular portion 14B disposed outside or exteriorly of the inner annular housing 18 that surrounds the inner annular housing 18 and the central portion 14A of the interior cavity 14. The lamp holding means 20 supports the illumination lamp 22 below the roof 16 outside of the inner annular housing 18 and in the outer annular portion 14B of the interior cavity 14. The annular louver 24 is disposed within the outer annular portion 14B of the interior cavity 14 outside of the inner annular housing 18 and underneath the illumination lamp holding means 20 such that the annular louver 24 has to be removed therefrom in order to gain access to the outer annular portion 14B of the interior cavity 14 to install or replace the illumination lamp 22. The annular support element 26 is detachably secured on the annular inner housing 18 and projects radially outwardly therefrom relative to a central vertical axis 28 of the luminaire 10 so as to removably support the annular louver 24 within the outer annular portion 14B of the interior cavity 14 below the illumination lamp supporting means 20.

More particularly, the outer annular housing 12 has a cylindrical configuration, is open at opposite upper and lower ends 12A, 12B and forms the interior cavity 14 therebetween. The roof 16 has a flat shape and upper and lower faces 16A, 16B and is disposed in a substantially overlying relationship to the open upper end 12A of the outer housing 12 and the interior cavity 14 thereof. The roof 16 has several brackets 30 attached thereon which are bent at an angle and extend downwardly from the lower face 16B of the roof 16 and attach to the outer housing 12 via corresponding grooves 32 defined thereon so as to support the outer housing 12 below the roof 16. The luminaire 10 also includes an electronic fluorescent lamp ballast 34 disposed in the central portion 14A of the interior cavity 14 and mounted approximately centrally on the lower face 16B of the roof 16.

Figure 3:
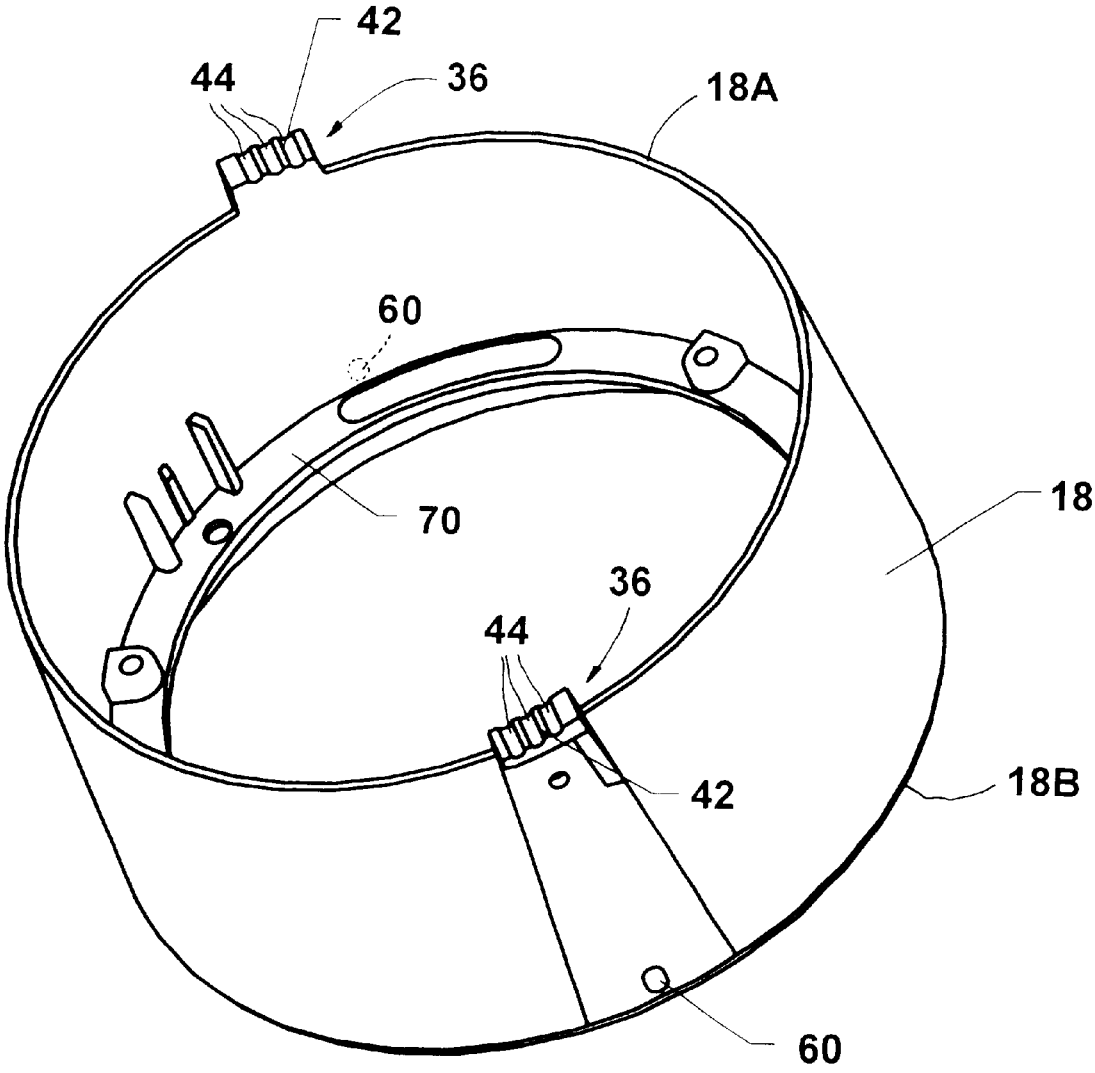
FIG. 3 is an enlarged perspective view of an inner annular housing of the luminaire of FIG. 1.

Referring to FIGS. 1 to 3, the inner annular housing 18 has a cylindrical configuration and opposite top and bottom ends 18A, 18B. The inner housing 18 is disposed within and concentrically with the outer housing 12 relative to the central vertical axis 28 of the luminaire 10. The inner housing 18 is spaced radially inwardly from the outer housing 12 relative to the vertical axis 28 of the luminaire 12 so as to separate the interior cavity 14 into the central portion 14A disposed inside or interiorly of the inner housing 18 and the outer annular portion 14B disposed outside or exteriorly of the inner housing 18 which surrounds the inner housing 18 and the central portion 14A of the interior cavity 14. The luminaire 10 also includes means 36 for detachably securing the inner housing 18 to the roof 16. The means 36 basically includes elements on the roof 16 and on the inner housing 18 which cooperate with each other such that, by rotation of the inner housing 18 relative to the roof 16, the inner housing 18 can be detached from and reattached to the roof 16. More particularly, the detachable securing means 36 includes a plurality of break-throughs 38 defined on the roof 16, a plurality of Z-form retaining elements 40 provided on the roof 16 above the break-throughs 38, and a plurality of lugs 42 on the top end 18A of the inner housing 18. The lugs 42 are adapted to pass through the break-throughs 38 and detachably engage with the retaining elements 40 on the roof 16. Further, as best seen in FIG. 3, the lugs 42 on the inner housing 18 have depressions 44 formed on top sides thereof and the retaining elements 40 on the roof 16 are shaped so as to provide snap-in engagement with the depressions 44 on the lugs 42. By rotation of the inner housing 18, the lugs 42 are moved into enlarged regions of the break-throughs 38 such that in this position the inner housing 18 can be pulled off in the downward direction. The inner housing 18 in such manner is thus suspended below the luminaire roof 16 and is detachable by rotation of the inner housing 18 relative thereto.

In the outer annular portion 14B of the interior cavity 14, a plurality of C-shaped holders 46 and a plug 48 of the lamp holder means 20 are supported below the lower face 16B of the roof 16 and extend into the outer annular portion 14B of the interior cavity 14 for mounting the illumination lamp 22. The luminaire 10 further includes an annular reflector 50 provided in the outer annular portion 14B of the interior cavity 14. The reflector 50 has inner and outer walls 50A, 50B attached to and extending downward from a top wall 50C thereof. At the top wall 50C, the reflector 50 is attached on the lower face 16B of the roof 16 via the lamp holders 46. The inner and outer walls 50A, 50B of the reflector 50 extend in opposing radially spaced apart relationships to and past the lamp holders 46 and opposite inner and outer sides of the illumination lamp 22 mounted by the lamp holders 46. The inner and outer walls 50A, 50B of the reflector 50 defines an annular chamber 52 therebetween open at a bottom thereof. The annular louver 24 is provided underneath the illumination lamp 22 extending upwardly through the bottom and within the annular chamber 52 of the reflector 50 such that the louver 24 has to be removed from the reflector 50 in order to gain access to the annular chamber 52 to install or replace the lamp 22.

Figure 4:
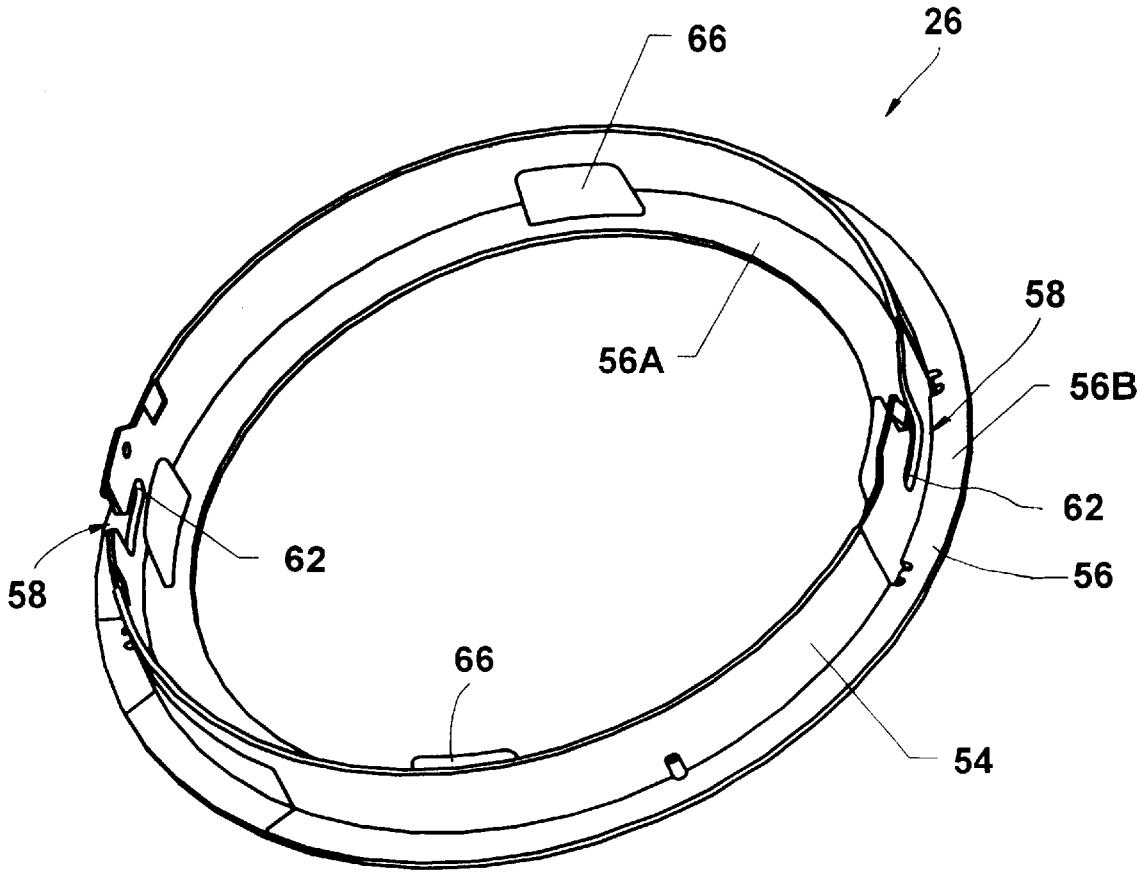
FIG. 4 is an enlarged perspective view of an annular support element of the luminaire of FIG. 1 detachably fastened on a bottom end of the inner annular housing of FIG. 3.

Referring now to FIGS. 1, 2 and 4, the annular support element 26 which supports the louver 24 within the annular chamber 52 of the reflector 50 and within the outer annular portion 14B of the interior cavity 14 has an inverted T shape in cross-section and includes a upright middle annular web 54 and a bottom annular web 56 integrally connected to one another. The bottom annular web 56 extends in a transverse relationship to and in opposite directions from the upright middle annular web 54 and from the bottom end 18B of the inner housing 18. The luminaire 10 also includes means 58 in the form of a bayonet socket for detachably securing the annular support element 26 to the bottom end 18B of the inner housing 18. The detachable securing means 58 basically includes elements on the annular support element 26 and on the inner housing 18 which cooperate with each other such that, by rotation of the annular support element 26, the annular support element 26 can be detached from and reattached to the inner housing 18. More particularly, the detachable securing means 58 includes a plurality of lugs 60 on the exterior of the inner housing 18 adjacent to the bottom end 18B thereof and circumferentially spaced from one another, and a plurality of slots 62 defined in the upright middle annular web 54 of the annular support element 26 and being alignable with the lugs 60 for receiving the lugs 60 to thereby detachably secure the annular support element 26 to the inner housing 18. By rotation of the annular support element 26 relative to the inner housing 18, the lugs 60 are moved into or from the slots 62 and the annular support element 26 in such manner is either mounted to the inner housing 18 or detached therefrom.

The bottom annular web 56 of the annular support element 26 luminaire 10 includes an inner portion 56A and an outer portion 56B. The inner portion 56A of the bottom annular web 56 projects inwardly from the bottom end 18B of the inner annular housing 18 and the outer portion 56B of the bottom annular web 56 projects outwardly therefrom. The luminaire 10 includes a covering pane 64 of circular configuration removably supported in the central portion 14A of the interior cavity 14 across the bottom end 18B of the inner housing 18 by the inner portion 56A of the bottom annular web 56 of the annular support element 26. The covering pane 64 additionally can be fastened by suitable means to the bottom end 18B of the inner housing 18 such that when the annular support element 26 is removed for the purposes of lamp change the pane 64 remains disposed across the bottom end 18B of the inner housing 18.

Furthermore, several web elements 66 are mounted on the inner portion 56A of the bottom web 56 and disposed parallel to the middle annular web 54 of the annular support element 26 and offset toward the inside thereof. With guidance by these web elements 66, the annular support element 26 is easily centered on the inner housing 18. It can be held securely through additional retaining clips 68 which can be slipped onto the web elements 66 of the annular support element 26. The annular louver 24 is supported upon the outer portion 56B of the bottom annular web 56 of the annular support element 26 and thus is removed with detachment of the annular support element 26 from the inner housing 18.

In the central portion 14A of the interior cavity 14 enclosed by the inner housing 18 is provided another annular web 70 on which accessory parts, in particular coverings, can be fastened. Also, on corresponding fastening or receiving means in the inner housing 18 according to the invention the most diverse installation parts, such as additional lamps, emergency light components, components for light management, smoke alarms, loudspeakers, monitoring cameras or other covering or decoration panes, can be accommodated. If the luminaire accessories are accommodated separately outside of the luminaire 10 and if the center of the luminaire roof 16 is punched out, free access to the hollow space of the ceiling is obtained and it is possible to introduce, for example, fresh and exhaust air devices, sprinkler devices and the like into the inner housing 18. An outer cover ring 72 is supported on the bottom end 12B of the outer housing 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A luminaire, comprising:

(a) an outer annular housing defining a central axis of the luminaire and an interior cavity having at least a lower opening;

(b) a roof disposed in an overlying relationship to said outer annular housing and said interior cavity thereof opposite from said lower opening;

(c) an inner annular housing having top and bottom ends and supported at said top end from said roof and arranged within, concentric with and spaced radially inwardly from said outer annular housing relative to said central axis so as to separate said interior cavity thereof into a central portion disposed inside said inner annular housing for the installation of accessory parts and an outer annular portion disposed outside said inner annular housing and concentrically surrounding said inner annular housing and said central portion of said interior cavity for the arrangement in said outer annular portion of an annular illumination lamp, said central portion and outer annular portion of said interior cavity both being open at said lower opening of said interior cavity;

(d) means for supporting the annular illumination lamp outside of said inner annular housing and in said outer annular portion of said interior cavity;

(e) an annular louver disposed within said outer annular portion of said interior cavity and spaced below said illumination lamp supporting means; and (f) an annular support element detachably secured on said annular inner housing and projecting radially outwardly therefrom so as to removably support said annular louver within said outer annular portion of said interior cavity below said illumination lamp supporting means.

2. The luminaire of claim 1 wherein said roof has a plurality of brackets extending downwardly therefrom and being attached to said outer annular housing so as to support said outer annular housing below said roof.

3. The luminaire of claim 1 further comprising:

means for detachably securing said inner annular housing to said roof.

4. The luminaire of claim 3 wherein said means for detachably securing said inner annular housing to said roof includes elements on said roof and said inner annular housing which cooperate with each other such that by rotation of said inner annular housing relative to said roof said inner annular housing can be detached from and reattached to said roof.

5. The luminaire of claim 3 wherein said means for detachably securing said inner annular housing to said roof includes:

a plurality of breakthroughs defined on said roof;

a plurality of retaining elements provided on said roof adjacent to said break-throughs; and a plurality of lugs on said top end of said inner annular housing adapted to pass through said break-throughs and detachably engage with said retaining elements on said roof.

6. The luminaire of claim 5 wherein said lugs on said inner annular housing have depressions formed on top sides thereof and said retaining elements on said roof are shaped so as to provide snap-in engagement with said lugs.

7. The luminaire of claim 1 further comprising:

an illumination lamp ballast disposed in said central portion of said interior cavity and mounted to said roof.

8. The luminaire of claim 1 further comprising:

means for detachably securing said annular support element to said inner annular housing.

9. The luminaire of claim 8 wherein said means for detachably securing said annular support element to said inner annular housing includes elements on said inner annular housing and said annular support element which cooperate with each other such that by rotation of said annular support element relative to said inner annular housing said annular support element can be detached from and reattached to said inner annular housing.

10. The luminaire of claim 8 wherein said means for detachably securing said annular support element to said inner annular housing includes:

a plurality of lugs on one of said inner annular housing and said annular support element; and a plurality of slots defined in the other of said inner annular housing and said annular support element and being alignable with said lugs for receiving said lugs to thereby detachably secure said annular support element to said inner annular housing.

11. The luminaire of claim 10 wherein said annular support element includes a upright middle annular web having said slots defined therein.

12. The luminaire of claim 11 wherein said annular support element further includes a bottom annular web extending in a transverse relationship to and in opposite directions from said upright middle annular web and from said bottom end of said inner annular housing.

13. The luminaire of claim 12 further comprising:

a covering pane removably supported in said central portion of said interior cavity across said bottom end of said inner annular housing by an inner portion of said bottom annular web of said annular support element projecting inwardly from said bottom end of said inner annular housing.

14. The luminaire of claim 12 wherein said bottom annular web of said annular support element has an outer portion projecting outwardly from said bottom end of said inner annular housing that supports said annular louver.

15. A luminaire, comprising:

(a) an outer annular housing open at upper and lower ends and defining an interior cavity extending therebetween and having a lower opening, said outer annular housing also defining a central axis of the luminaire;

(b) a roof having upper and lower faces and being disposed in a substantially overlying relationship to said open upper end of said outer annular housing and said interior cavity thereof, said roof having brackets extending downwardly from said lower face of said roof and being attached to said outer annular housing so as to support said outer annular housing below said roof;

(c) an inner annular housing having top and bottom ends and disposed within said outer annular housing and arranged concentric with and spaced radially inwardly from said outer annular housing with respect to said central axis so as to separate said interior cavity of said outer annular housing into a central portion disposed inside said inner annular housing for the installation of accessory parts and an outer annular portion disposed outside said inner annular housing and concentrically surrounding said inner annular housing and said central portion of said interior cavity for the arrangement in said outer annular portion of an annular illumination lamp, said central portion and outer annular portion of said interior cavity both being open at said lower opening of said interior cavity;

(d) means for detachably securing said inner annular housing to said roof;

(e) lamp holder means supported below said lower face of said roof and extending into said outer annular portion of said interior cavity for mounting the annular illumination lamp;

(f) an annular reflector provided in said outer annular portion of said interior cavity and having inner and outer walls extending downward from said lower face of said roof in opposing radially spaced apart relationships to and past said lamp holder means and opposite inner and outer sides of the illumination lamp when mounted by said lamp holder means, said inner and outer walls of said annular reflector defining an annular chamber therebetween open at a bottom thereof;

(g) an annular louver provided underneath said lamp holder means and the illumination lamp when mounted by said lamp holder means, said annular louver extending upwardly through said bottom of and within said annular chamber of said annular reflector such that said annular louver has to be removed from said annular reflector in order to gain access to said lamp holder means to install or replace an illumination lamp;

(h) an annular support element; and (i) means for detachably securing said annular support element on said bottom end of said annular inner housing such that said annular support element projects radially outwardly therefrom so as to removably support said annular louver within said annular chamber of said annular reflector.

16. The luminaire of claim 15 wherein said means for detachably securing said inner annular housing to said roof includes:

a plurality of break-throughs defined on said roof;

a plurality of retaining elements provided on said roof adjacent to said break-throughs; and a plurality of lugs on said top end of said inner annular housing adapted to pass through said break-throughs and detachably engage with said retaining elements on said roof.

17. The luminaire of claim 16 wherein said lugs on said inner annular housing have depressions formed on top sides thereof and said retaining elements on said roof are shaped so as to provide snap-in engagement with said lugs.

18. The luminaire of claim 15 further comprising:

an illumination lamp ballast disposed in said central portion of said interior cavity and mounted to said lower face of said roof.

19. The luminaire of claim 15 wherein said means for detachably securing said annular support element to said inner annular housing includes:

a plurality of lugs on one of said inner annular housing and said annular support element; and a plurality of slots defined in the other of said inner annular housing and said annular support element and being alignable with said lugs for receiving said lugs and to thereby detachably secure said annular support element to said inner annular housing.

20. The luminaire of claim 15 further comprising:

a covering pane removably supported in said central portion of said interior cavity across said bottom end of said inner annular housing by said annular support element.

* * * * *